US007088915B1

(12) United States Patent
Sturm et al.

(10) Patent No.: US 7,088,915 B1
(45) Date of Patent: Aug. 8, 2006

(54) MODULAR TANKLESS WATER HEATER

(75) Inventors: William R. Sturm, Tempe, AZ (US); Joseph M. Sullivan, Gilbert, AZ (US); Thomas J. Shortland, Tempe, AZ (US); Kevin Hay, Fountain Hills, AZ (US); Gregg C. Johnson, Peoria, AZ (US)

(73) Assignee: Ion Tankless, Inc., Chandler, AZ (US)

( * ) Notice: Subject to any disclaimer, the term of this patent is extended or adjusted under 35 U.S.C. 154(b) by 0 days.

(21) Appl. No.: 11/360,124

(22) Filed: Feb. 23, 2006

Related U.S. Application Data

(62) Division of application No. 11/080,300, filed on Mar. 15, 2005, now Pat. No. 7,046,922.

(51) Int. Cl.
*F24H 1/10* (2006.01)

(52) U.S. Cl. ..... 392/466; 392/465; 392/482; 392/490

(58) Field of Classification Search ..... None
See application file for complete search history.

(56) References Cited

U.S. PATENT DOCUMENTS 4,455,475 A * 6/1984 Giorgetti ..... 392/494
5,216,743 A * 6/1993 Seitz ..... 392/490
5,325,822 A * 7/1994 Fernandez ..... 392/491
5,408,578 A * 4/1995 Bolivar ..... 392/490
5,724,478 A * 3/1998 Thweatt ..... 392/484
6,167,845 B1 * 1/2001 Decker, Sr. ..... 122/40
6,175,689 B1 * 1/2001 Blanco, Jr. ..... 392/485
6,240,250 B1 * 5/2001 Blanco, Jr. ..... 392/490
6,246,831 B1 * 6/2001 Seitz et al. ..... 392/486
6,389,226 B1 * 5/2002 Neale et al. ..... 392/485

* cited by examiner

*Primary Examiner*—Thor S. Campbell
(74) *Attorney, Agent, or Firm*—Parsons & Goltry; Robert A. Parsons; Michael W. Goltry

(57) ABSTRACT

A tankless water heater module is disclosed and includes a casing having a first end, a second end and a plurality of conduits formed therein. A top head manifold is coupled to the first end of the casing and includes a port aligned with each of the plurality of conduits. A bottom head manifold is coupled to the second end of the casing and includes a port aligned with each of the plurality of conduits. An immersion heating element extends through each port of the top head manifold and into the conduit aligned therewith. A flow path extends through the plurality of conduits, the plurality of conduits coupled in fluid communication by channels between ports of the top head manifold and a channel between ports of the bottom head manifold.

7 Claims, 20 Drawing Sheets

MODULAR TANKLESS WATER HEATER

CROSS-REFERENCE TO RELATED APPLICATION

This application is a divisional application of U.S. patent application Ser. No. 11/080,300, filed 15 Mar. 2005 now U.S. Pat. No. 7,046,922.

FIELD OF THE INVENTION

This invention relates to water heaters.

More particularly, the present invention relates to water heaters of the type employing resistive heating elements.

BACKGROUND OF THE INVENTION

The need for heated fluids, and in particular heated water, has long been recognized. Conventionally, water has been heated by heating elements, either electrically or with gas burners, while stored in a tank or reservoir. While effective, energy efficiency and water conservation can be poor. As an example, water stored in a hot water tank is maintained at a desired temperature at all times. Thus, unless the tank is well insulated, heat loss through radiation can occur, requiring additional input of energy to maintain the desired temperature. In effect, continual heating of the stored water is required. Additionally, the tank is often positioned at a distance from the point of use, such as the hot water outlet. In order to obtain the desired temperature water, cooled water in the conduits connecting the point of use (outlet) and the hot water tank must be purged before the hot water from the tank reaches the outlet. This can often amount to a substantial volume of water.

Many of these problems have been overcome by the use of tankless water heaters. Heating water accurately and efficiently in a consistent and safe manner can be problematic with current tankless systems It would be highly advantageous, therefore, to remedy the foregoing and other deficiencies inherent in the prior art.

Accordingly, it is an object the present invention to provide a new and improved tankless water heater.

Another objective of the present invention is to provide a modular tankless water heater.

And another object of the present invention is to provide a tankless water heater having multiple safety features.

Yet another object of the present invention is to provide a tankless water heater which can have flow dynamics adjusted by the head manifolds.

SUMMARY OF THE INVENTION

Briefly, to achieve the desired objects of the present invention in accordance with a preferred embodiment thereof, provided is a tankless water heater module including a casing having a first end, a second end and a plurality of conduits formed therein, extending from the first end to the second end. A top head manifold is coupled to the first end of the casing and includes a port aligned with each of the plurality of conduits. A bottom head manifold is coupled to the second end of the casing and includes a port aligned with each of the plurality of conduits. An immersion heating element extends through each port of the top head manifold and into the conduit aligned therewith. Each immersion heating element is coupled to the top head manifold. An inlet is coupled to one of the plurality of conduits through the port of the bottom head manifold aligned therewith. An outlet is coupled to another one of the plurality of conduits through the port of the bottom head manifold aligned therewith. A flow path extends from the inlet to the outlet through the plurality of conduits, the plurality of conduits coupled in fluid communication by channels between ports of the top head manifold and a channel between ports of the bottom head manifold.

Also provided is a tankless water heater system having a power module coupled to a power source, a water heater module, a relay switch coupled to each immersion heating element and to the power module, and a control unit receiving fluid flow data and fluid temperature data from the water heater module. The control unit is coupled to the relay switches for actuating the relay switches upon selected fluid flow and fluid temperature data.

Also provided is a method of heating water including the steps of providing a tankless water heater module, injecting water into the flow path, sensing a flow rate of water through the flow path, sensing temperature of water entering the flow path and temperature of water exiting the flow path, and supplying power to selected heating elements determined by the flow rate, the temperature of water entering the flow path and the temperature of water exiting the flow path.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
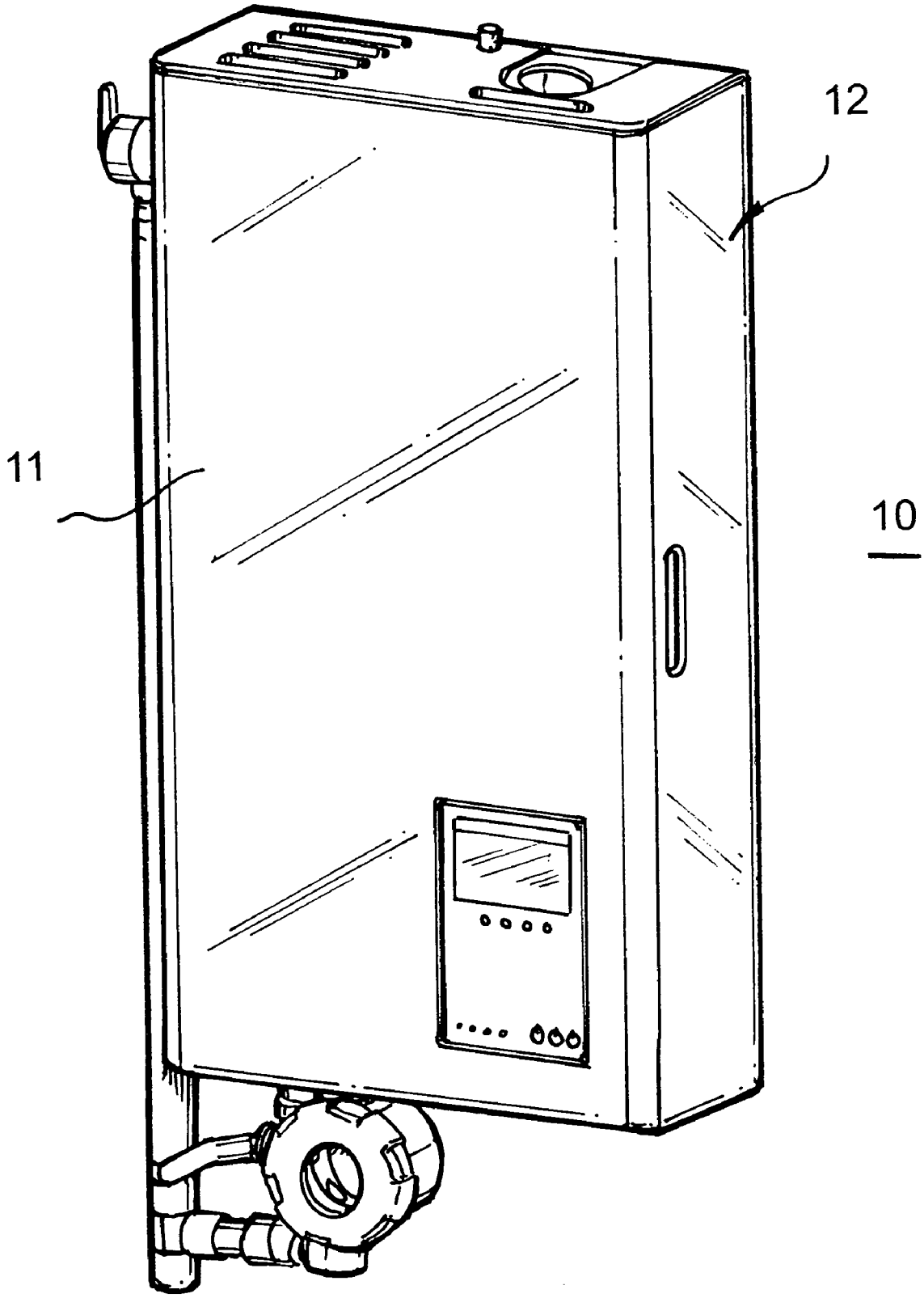
FIG. 1 is a perspective view of the tankless water heater system according to the present invention.

Turning now to the drawings in which like reference characters indicate corresponding elements throughout the several views, attention is directed to FIG. 1 which illustrates a tankless water heater system generally designated 10. System 10 includes a housing 12 closed by a cover 11. Tankless water heater system 10 is a system which heats water as its flows through. Electrical power is conserved by heating water only as it is needed. As water needs are increased, increasing amounts of energy are added to the flowing water to reach a desired temperature.

Figure 2:
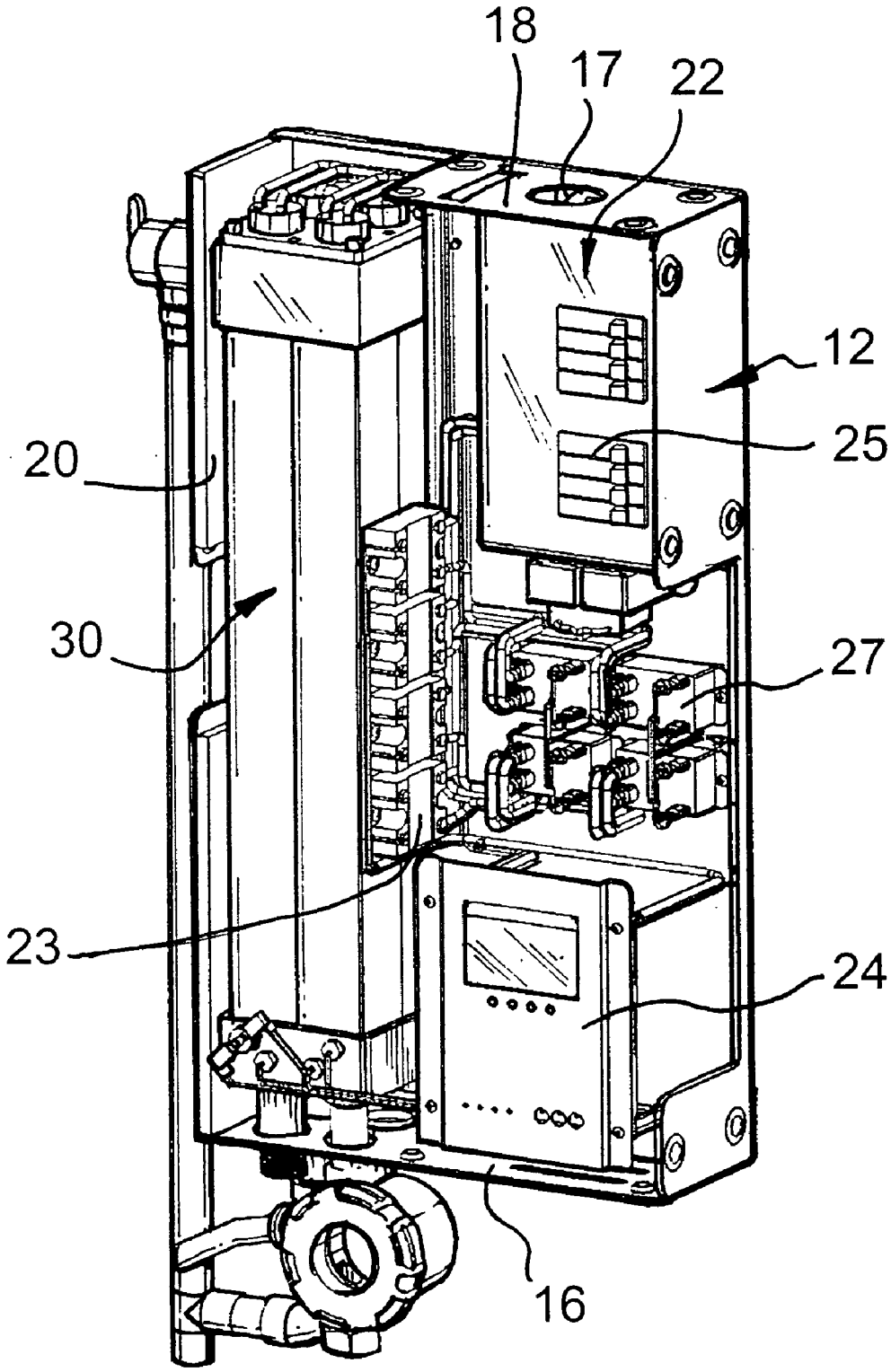
FIG. 2 is a perspective view of the tankless water heater system according to the present invention with the cover removed.
Figure 3:
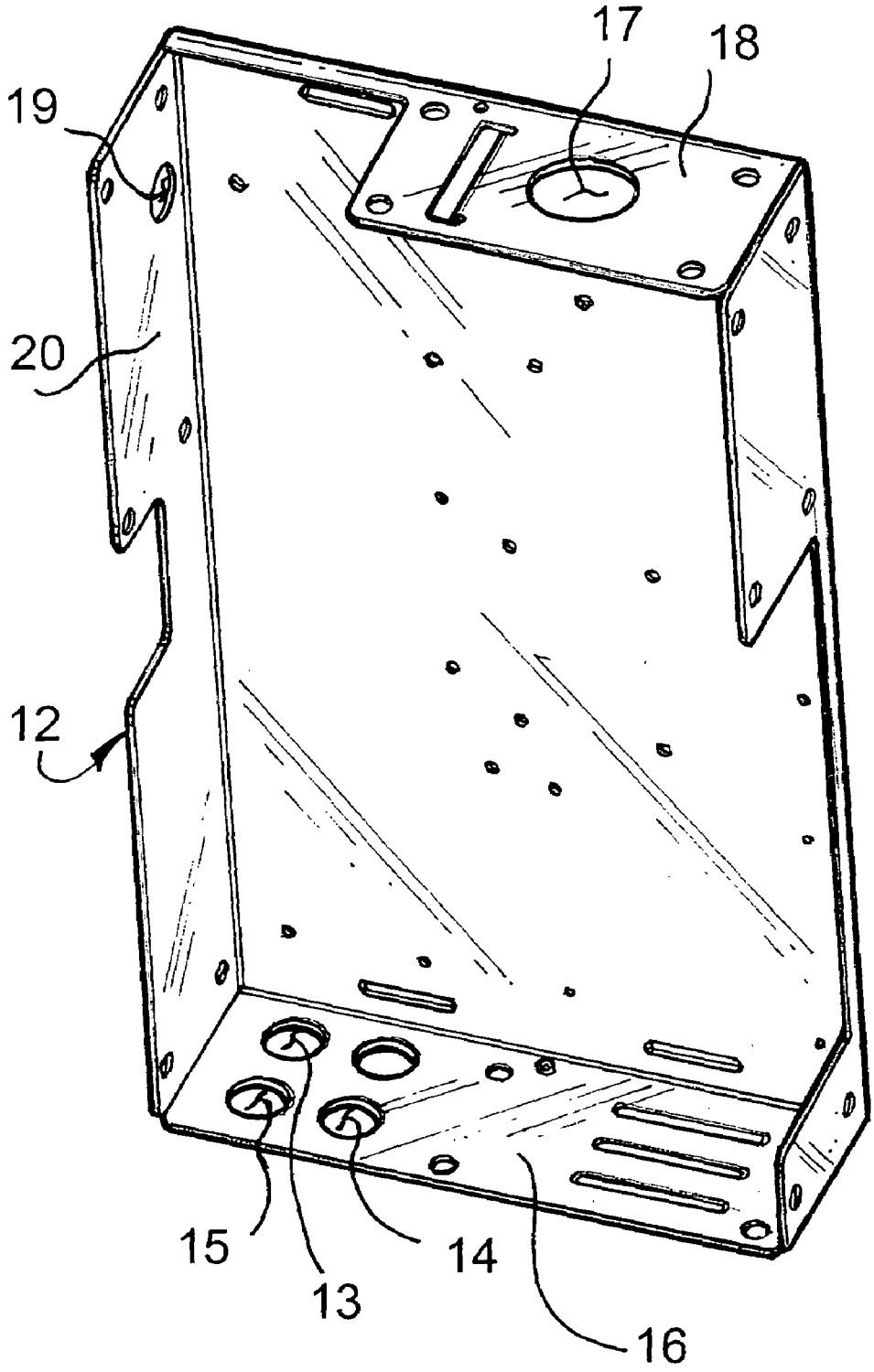
FIG. 3 is a perspective view of the housing of the tankless water heater.

Referring to FIGS. 2 and 3, housing 12 acts as a support structure for the various components of system 10, and includes a flush aperture 13, an inlet aperture 14 and an outlet aperture 15, each formed through a bottom sidewall 16. A power inlet 17 is formed in a top sidewall 18, and a safety valve aperture 19 is formed in a sidewall 20 extending perpendicularly between bottom sidewall 16 and top sidewall 18. Housing 12 carries a power module 22, with associated solid-state relay switches 23, a control unit 24, and a water heater module 30. For purposes of this description and clarity of orientation of the various elements, bottom is a term which will be used in conjunction with a direction toward bottom sidewall 16 of housing 12, and top is a term which will be used in conjunction with a direction toward top sidewall 18 of housing 12. It will be understood by those skilled in the art that housing 12 can be oriented to the surrounding environment in substantially any way, with, for example, bottom sidewall 16 oriented to the side, bottom or top.

Power module 22 includes a terminal and breaker switch combination 25 to provide safety and reduce associated elements needed for installation. No separate or outside breaker box is necessary for the installation of system 10. Control circuit 24 receives water flow and water temperature data, controlling water heater module 30 by actuating solid-state relay switches 23. System 10, in the preferred embodiment, also includes mechanical relays 27, which act as safety shut-offs when a predetermined temperature is equaled or exceeded. These relays are not coupled to controller 24 and are thus independent therefrom. Electrical power runs from breakers 25 through mechanical relays 27 to solid state relays 23. When signaled from controller 24, relays 23 provide power to module 30.

Figure 4:
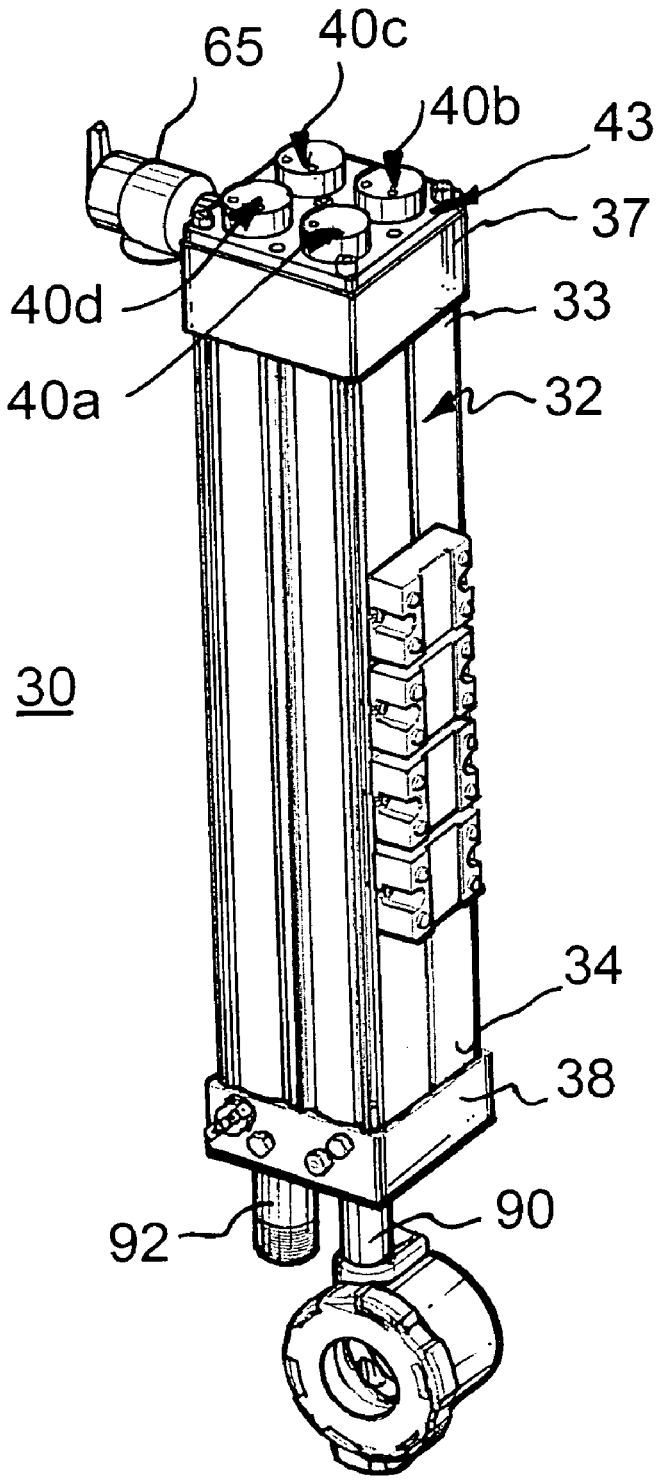
FIG. 4 is a perspective view of the tankless water heater module according to the present invention.
Figure 5:
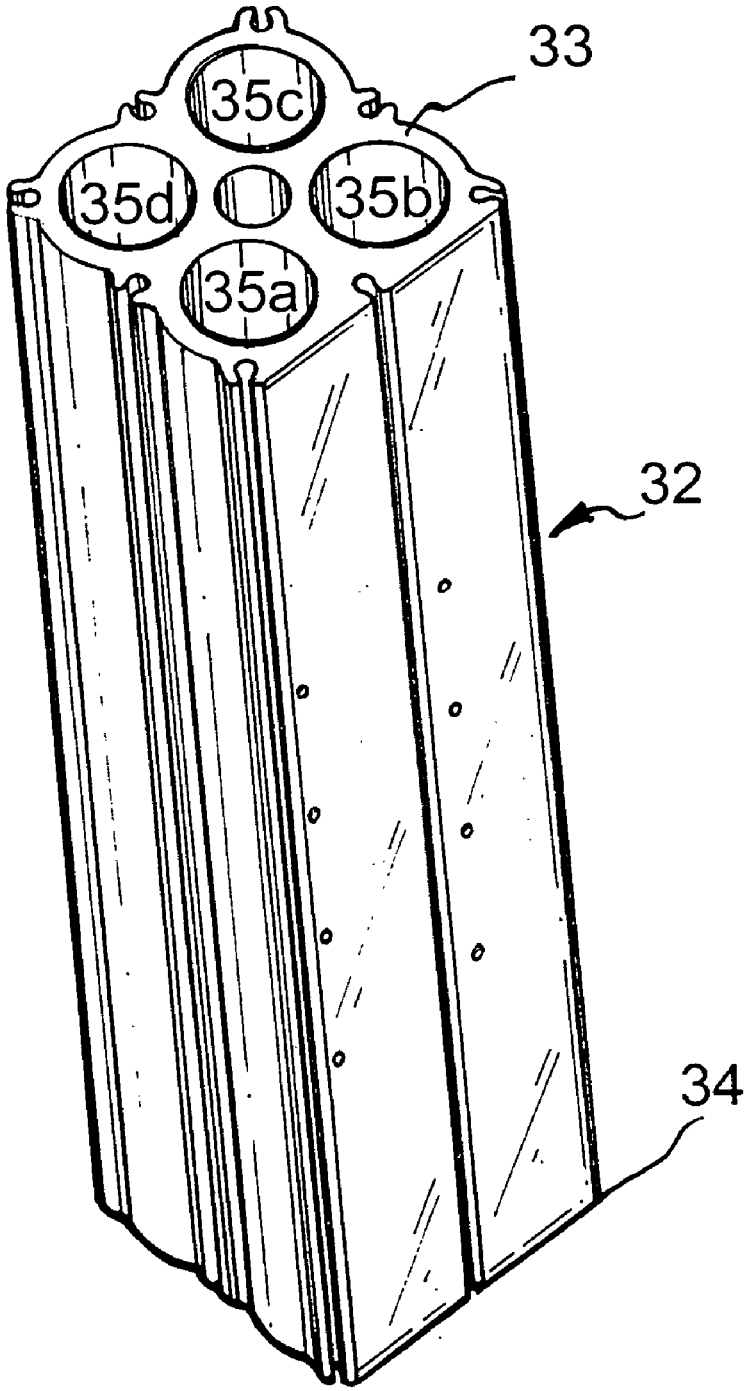
FIG. 5 is a perspective view of the casing of the tankless water heater module.

Turning now to FIG. 4, with additional reference to FIG. 5, water heater module 30 includes a casing 32 which includes a top end 33, a bottom end 34, and a plurality of conduits 35 extending therethrough from top end 33 to bottom end 34. In the preferred embodiment, four conduits 35*a*, 35*b*, 35*c*, and 35*d* are employed, although more or less can be used. It has been found that four is the optimal number, with greater capacity achieved by employing additional modules, as will be described presently. A top head manifold 37 is coupled to top end 33 and a bottom head manifold 38 is coupled to bottom end 34. Heating elements 40 extend through top head manifold 37 into conduits 35. Conduits 35 are sized sufficient to receive heating elements 40 therein, preferably without contact between heating elements 40 and the side of the respective conduit 35. In this embodiment, four heating elements 40*a*, 40*b*, 40*c*, and 40*d* are employed, one for each conduit 35*a–d*, respectively. As can be seen, casing 32 is generally square in cross-section, with a conduit 35 positioned in each quadrant of the square cross-section. In this configuration, each conduit 35 shares two sides with adjacent conduits. The result of this orientation is to reduce the footprint of water heater module 30 and to conserve heat within the unit. As will become apparent in the ongoing description, heat radiating from one conduit will radiate into adjacent conduits thereby reducing heat loss and increasing efficiency. Additionally, solid-state relay switches 23 are preferably mounted on casing 32 to act as a heat sink. By mounting solid-state relay switches 23 on casing 32, cold water passing therethrough will collect heat from the relays increasing their longevity. The heat energy generated by relay switches 23 will also be conserved by its addition to the water being heated. As will be understood, relays 23 are preferably mounted to a side of casing 32 through which the coolest water passes, such as proximate an inlet thereof. Due to its unique shape, casing 32 can be constructed in a variety of manners, including extrusion molding. By employing extrusion molding, fabrication costs can be greatly reduced.

Figure 9:
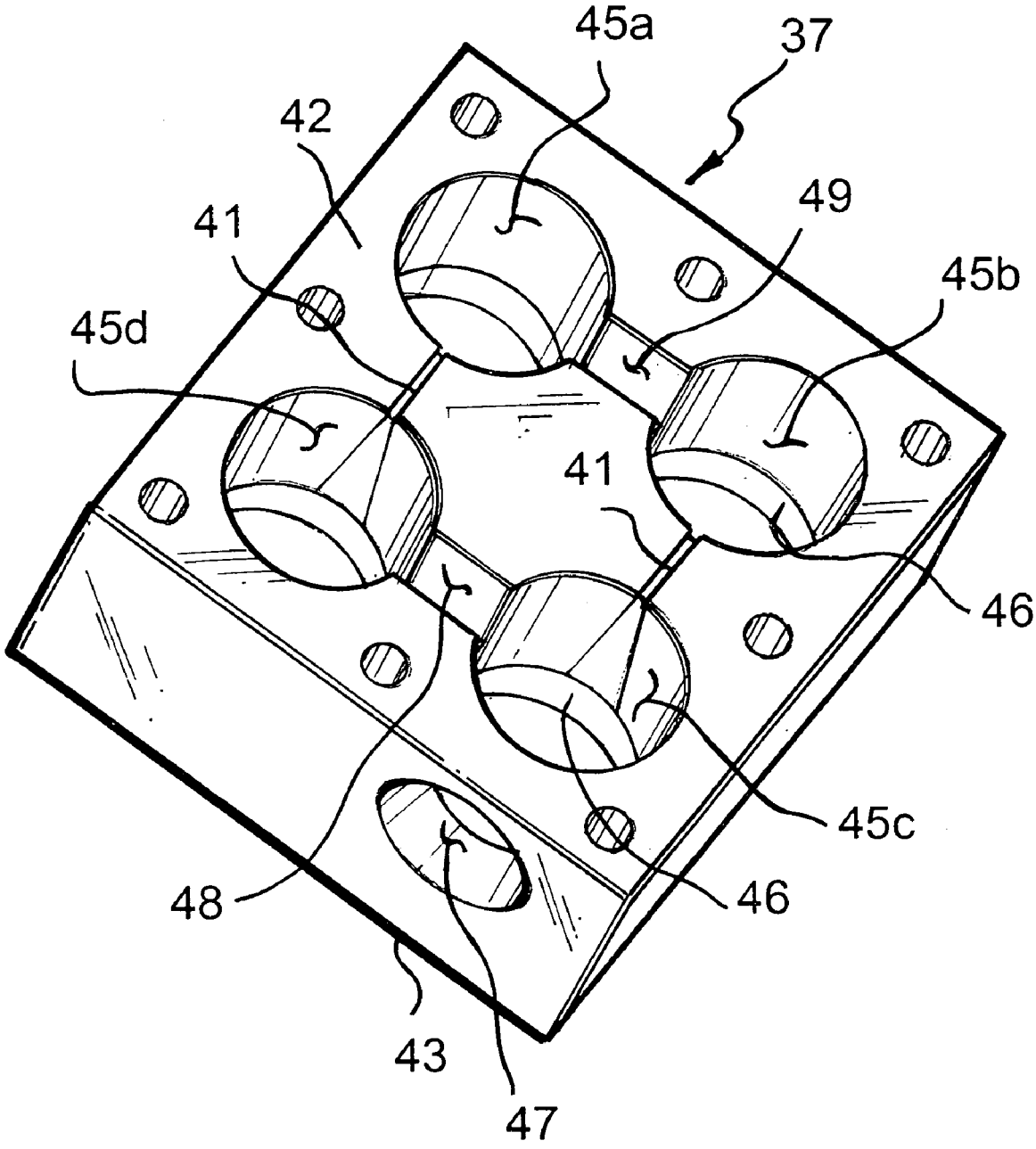
FIG. 9 is a bottom perspective view of the top head manifold.

Referring to FIG. 9, top head manifold 37, in this embodiment, has a generally square cross-section adapted to match top end 33 of casing 32. Top head manifold 37 includes a bottom surface 42 and a top surface 43. Ports 45*a*, 45*b*, 45*c*, and 45*d* are formed through top head manifold 37 extending from bottom surface 42 to top surface 43. Bottom surface 42 abuts top end 33 of casing 32 with ports 45*a–d* aligning with conduits 35*a–d*, respectively. A side port 47 is formed through a side of top head manifold 37 in communication with port 45*c*. Bottom surface 42 includes a channel 48 coupling port 45*c* with port 45*d* and a channel 49 coupling port 45*a* with port 45*b*. The depth and/or width of channel 48 and channel 49 can be increased or decreased depending upon the velocity and turbulence of fluid flow desired between conduits 35*c* and 35*d* and conduits 35*a* and 35*b*. Each port 45*a–d* has a counter bore formed from top surface 43, to a point intermediate top surface 43 and bottom surface 42. The counter bore creates a shoulder 46 within each port 45*a–d*. Bypasses 41 extend between ports 45*a* and 45*d*, and between ports 45*b* and 45*c*. Bypasses 41 are shallow and are intended to allow any trapped air or bubbles to equalize between ports 45. By diffusing between the ports, any build up in one conduit will be diffused between all, reducing the overall volume taken up by air in any one conduit.

Figure 10:
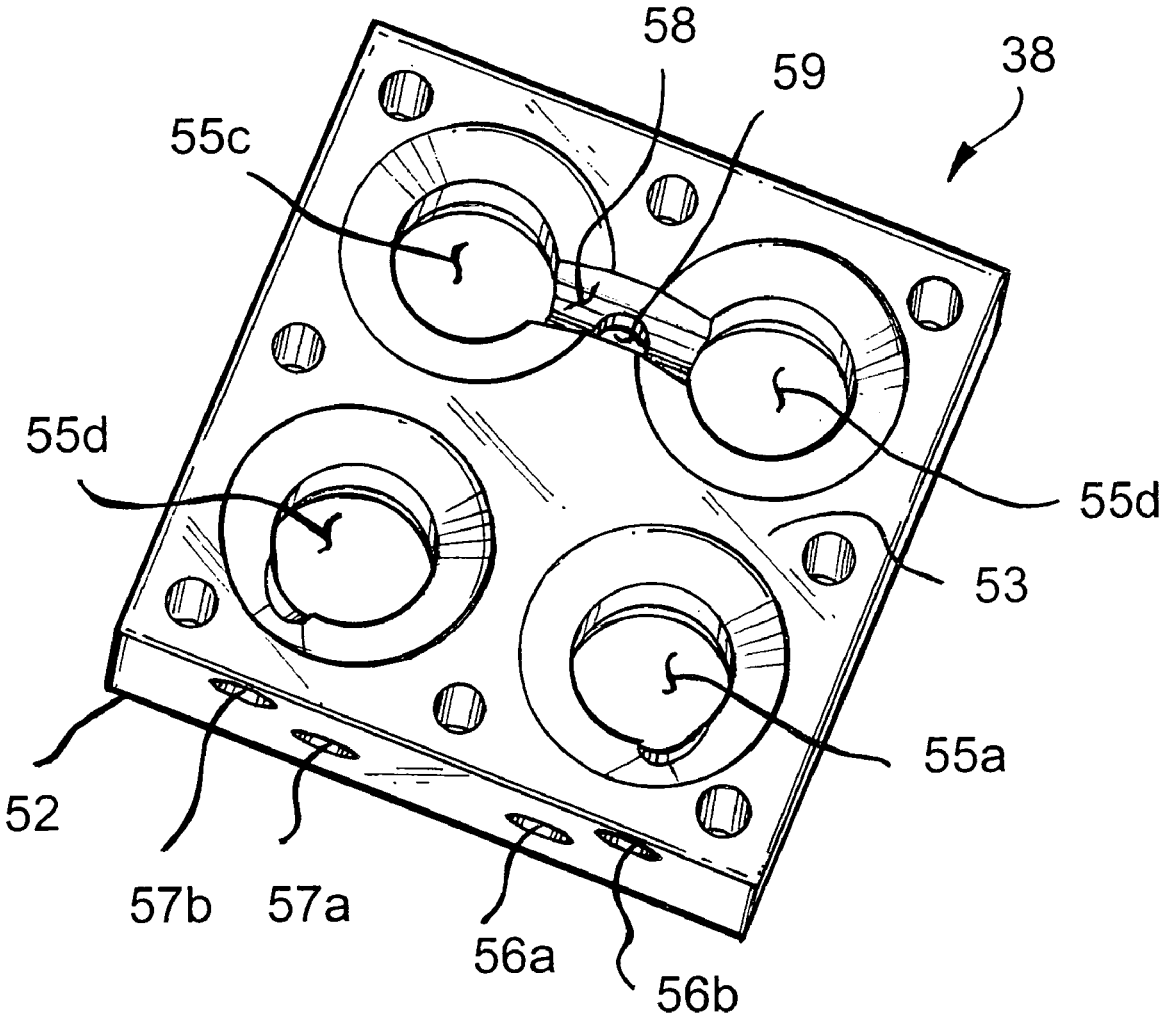
FIG. 10 is a top perspective view of the bottom head, manifold.

With reference to FIG. 10, bottom head manifold 38, in this embodiment, has a generally square cross-section adapted to match bottom end 34 of casing 32. Bottom head manifold 38 includes a bottom surface 52 and a top surface 53. Ports 55*a*, 55*b*, 55*c*, and 55*d* are formed through bottom head manifold 38 extending from bottom surface 52 to top surface 53. Caps 56 are employed to close ports 55*b* and 55*c* at bottom surface 52, although port 55*c* can be used for a flush mechanism described later. Substantially any engagement mechanism may be employed to secure caps 46 to ports 55*b* and 55*c*, such as pressure fit, threaded engagement, or the like. Ports 55*b* and 55*c* are preferably formed entirely through bottom head manifold 38 so as to permit extrusion molding thereof and for additional features such as the flushing mechanism. However it will be understood by those skilled in the art that if molding, machining or other techniques are employed, ports 55*b* and 55*c* may be fabricated with a closed end at bottom surface 52. Top surface 53 abuts bottom end 34 of casing 32 with ports 55*a–d* aligning with conduits 35*a–d*, respectively. Apertures 56*a* and 56*b* are formed through a side of bottom head manifold 38 in communication with port 55*a*. Apertures 57*a* and 57*b* are formed through a side of bottom head manifold 38 in communication with port 55*d*. Top surface 53 includes a channel 58 coupling port 55*b* with port 55*c*. The depth and/or width of channel 58 can be increased or decreased depending upon the velocity of fluid flow desired between conduit 35*b* and conduit 35*c*. Another sensor aperture 59 can be formed through channel 58 to bottom surface 52.

Figure 6:
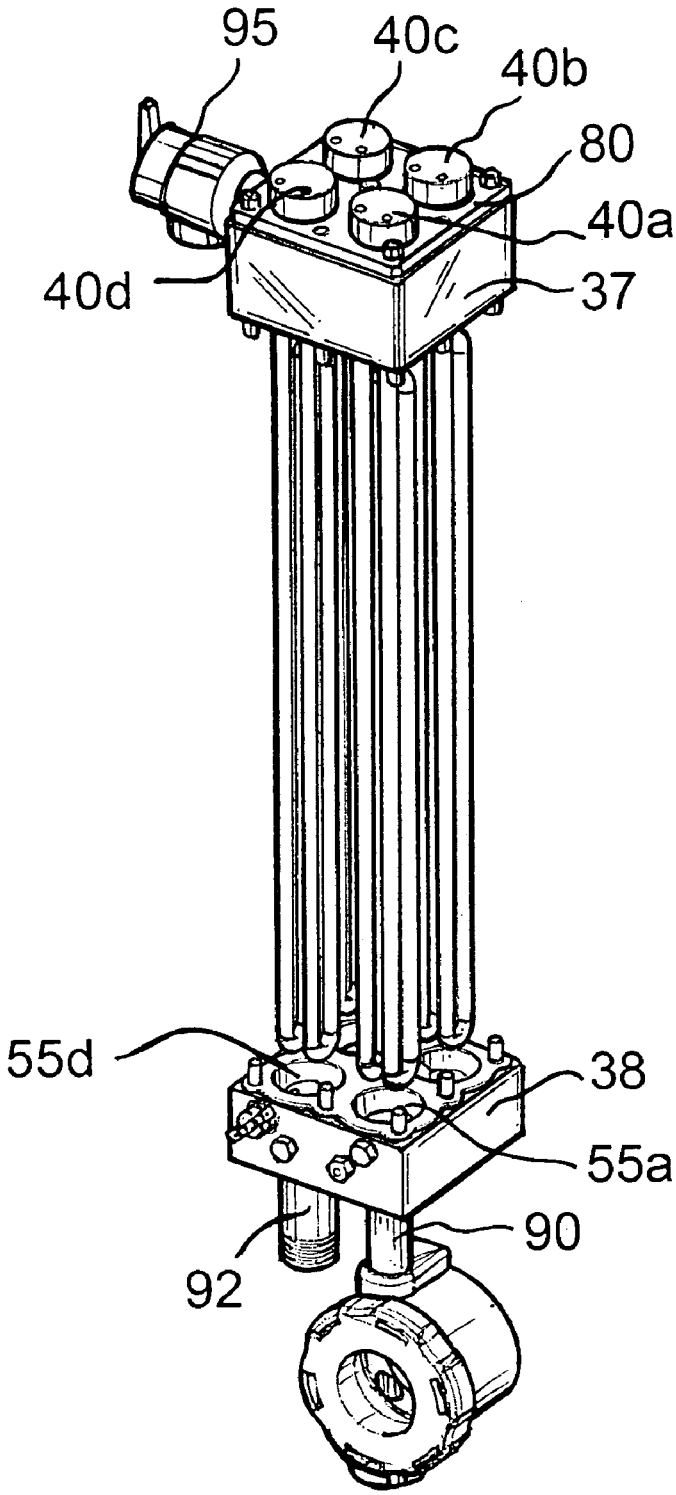
FIG. 6 is a perspective view of the tankless water heater module of FIG. 4 with the casing removed.
Figure 7:
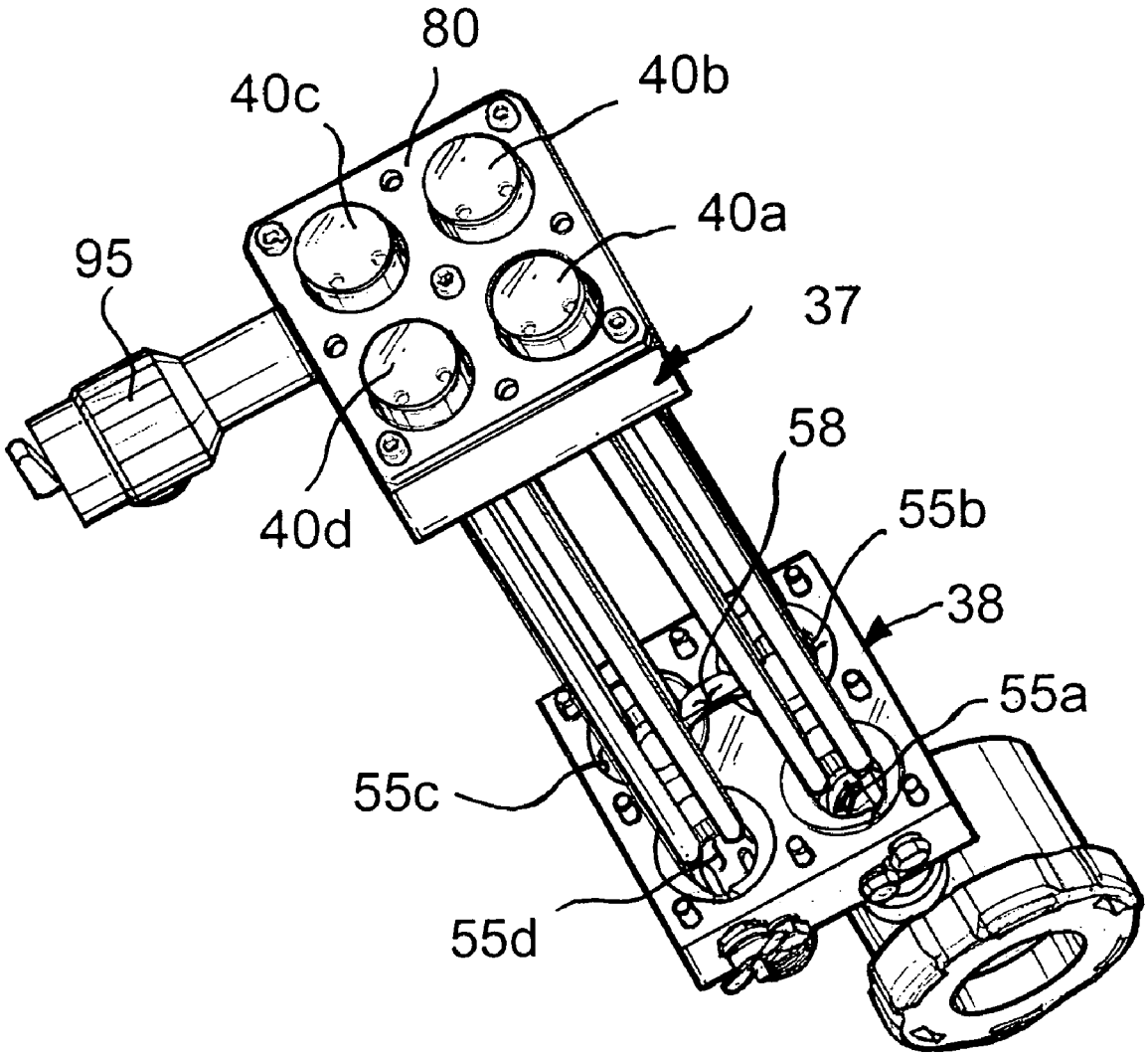
FIG. 7 is a top perspective view of the tankless water heater module of FIG. 10.
Figure 8:
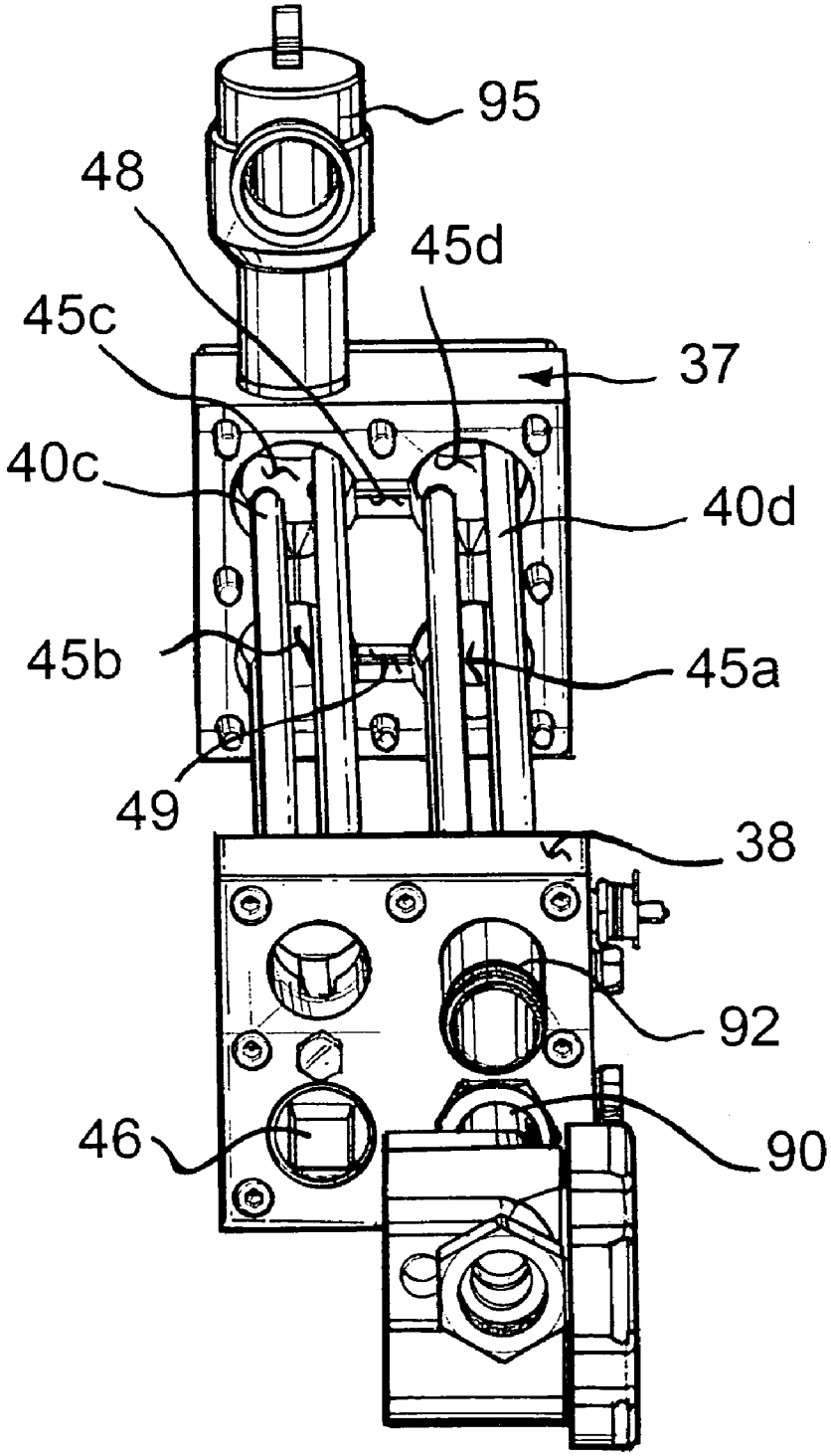
FIG. 8 is a bottom perspective view of the tankless water heater module of FIG. 10.

Referring now to FIGS. 6, 7, and 8, water heater module 30 is illustrated without casing 32 to facilitate the description of the placement of heating elements 40 and the operation of top head manifold 37 and bottom head manifold 38. Heating elements 40*a*, 40*b*, 40*c*, and 40*d* are each received through ports 45*a*, 45*b*, 45*c*, and 45*d*, respectively, of top head manifold 37, extend through conduit 35*a*, 35*b*, 35*c*, and 35*d*, respectively, of casing 32 and terminate proximate port 55*a*, 55*b*, 55*c*, and 55*d*, respectively, of bottom head manifold 38. Heating elements 40 can be secured in position with caps of each received within ports 45 of top head manifold 37. Ports 45 can be threaded to threadably receive and securely hold the caps with matching threads. The caps would be threaded into ports 45 to effectively seal ports 45 and to permit quick and easy removal thereof. While this is a likely removable engagement mechanisms, the preferred method of attachment is illustrated in FIGS. 12, 13, 14, and 15, as will be described presently. The purpose for providing an easily disengageable engagement between heating elements 40 and ports 45 is to permit quick and easy exchange of heating elements 40. Heating elements 40 can have greater or lesser heating capability. Thus, if higher temperatures, greater flow rates or just larger volumes of water are desired, higher output heating elements 40 can replace lower output elements in water heater modules 30. As an example, a water heater system 10 having a single module 30 is installed at a location. Over time, larger volumes of water are used, increasing the flow rate of water through water heater module 30 and maxing out its performance. Instead of having to replace the entire module to upgrade the performance, the lower capacity heating elements are replaced with greater capacity elements. At some point, if performance needs to increase past the level of replacing heating elements, additional water heater modules can be installed to expand the system, as will be described presently.

Figure 14:
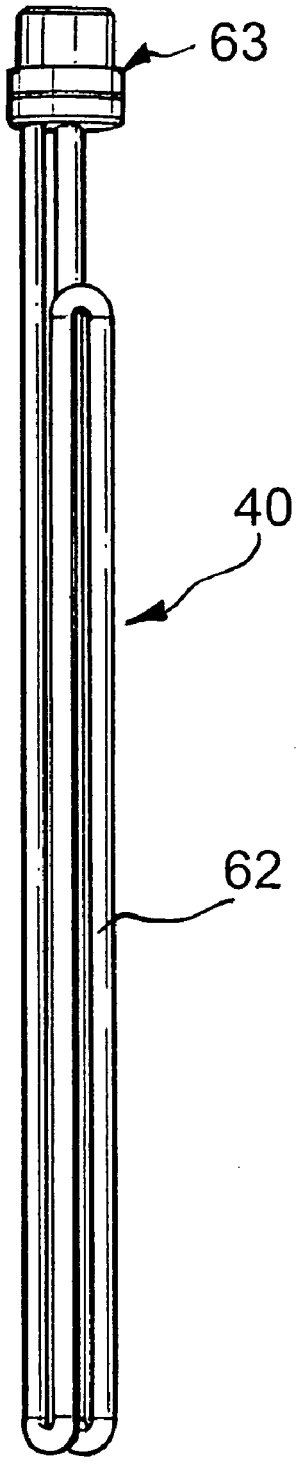
FIG. 14 is a perspective view of a heating element used in the tankless water heater module with a portion of the element coupling assembly.
Figure 15:
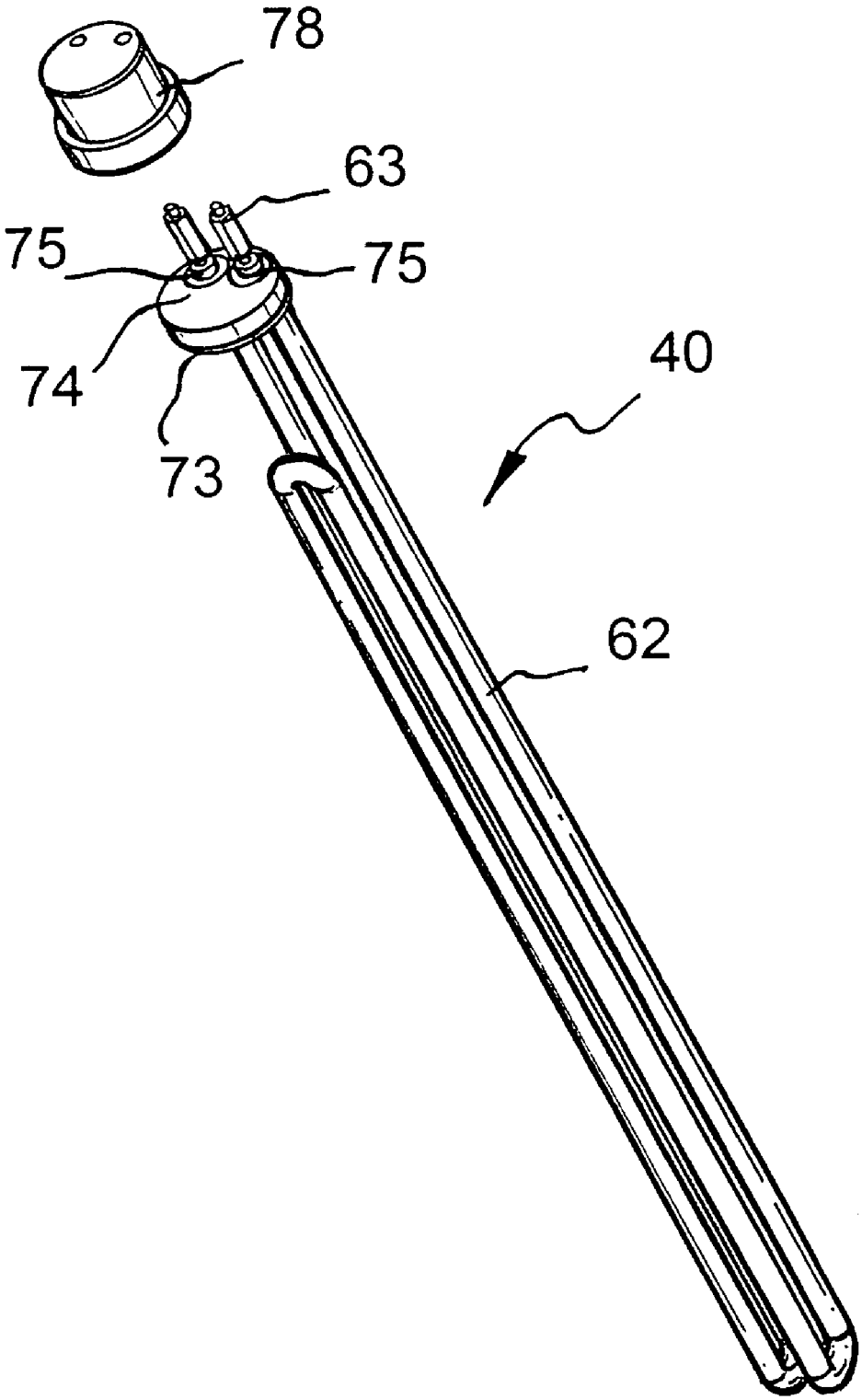
FIG. 15 is a perspective view of the heating element of FIG. 14, with a portion of the element coupling assembly exploded therefrom.

With reference to FIGS. 14 and 15, each heating element 40 is an elongated immersion resistive heating element 62 terminating in leads 63. In this embodiment an element coupling assembly 70 couples each heating element 40 to top head manifold 37 and provides safe connection between power module 22 and heating elements 40. Element coupling assembly 70 includes a cap assembly 72 carried by leads 63 of each heating element 40, and for purposes of this disclosure, is considered a part thereof. Cap assembly 72 includes an O-ring 73, a seal housing 74 holding seals 75, and a compression cap 78. Leads 63 are received through O-rings 73 carried by seal housing 74 and into apertures 79 formed through compression cap 78.

Figure 12:
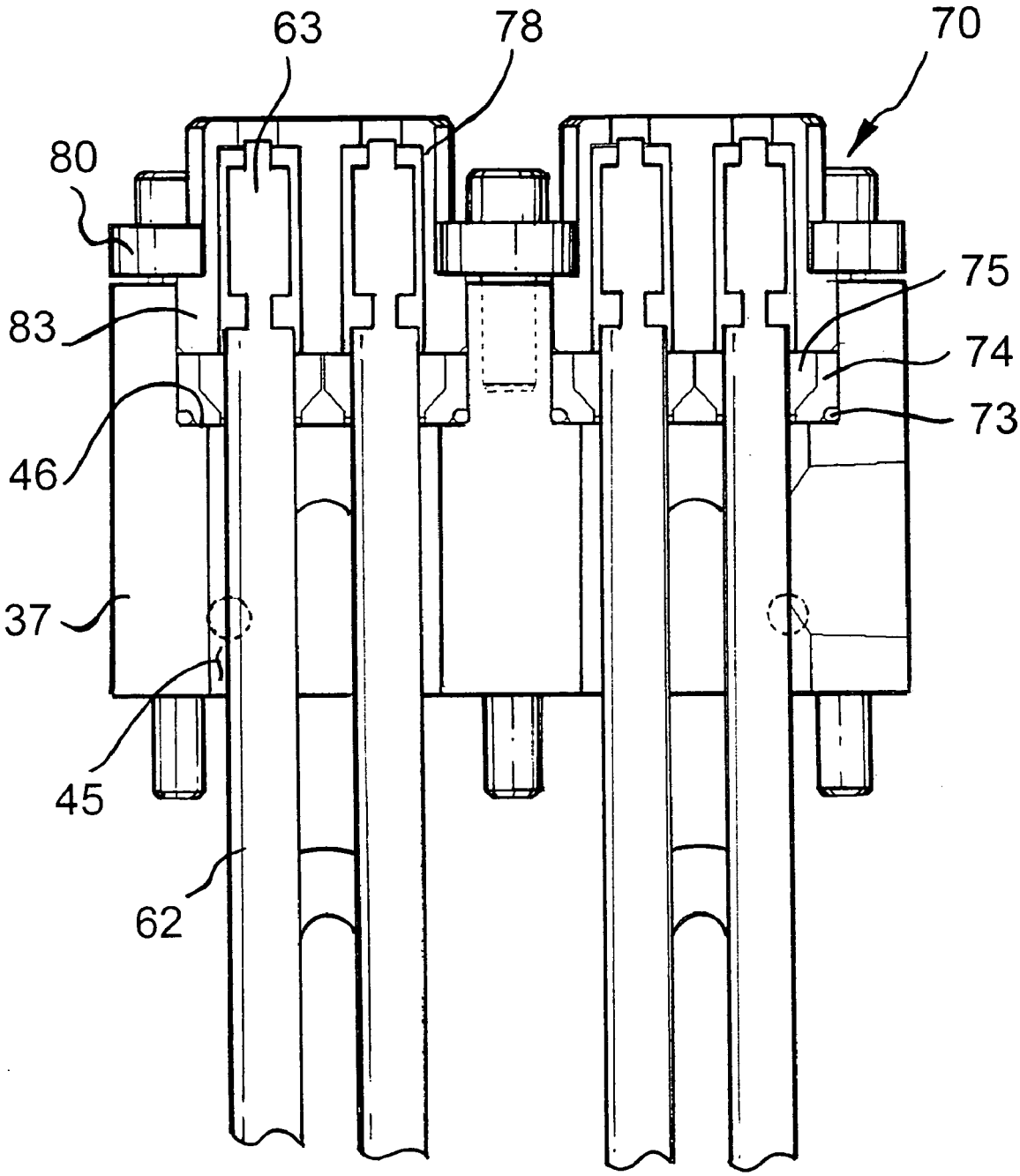
FIG. 12 is an enlarged sectional side view of the element coupling assembly.
Figure 13:
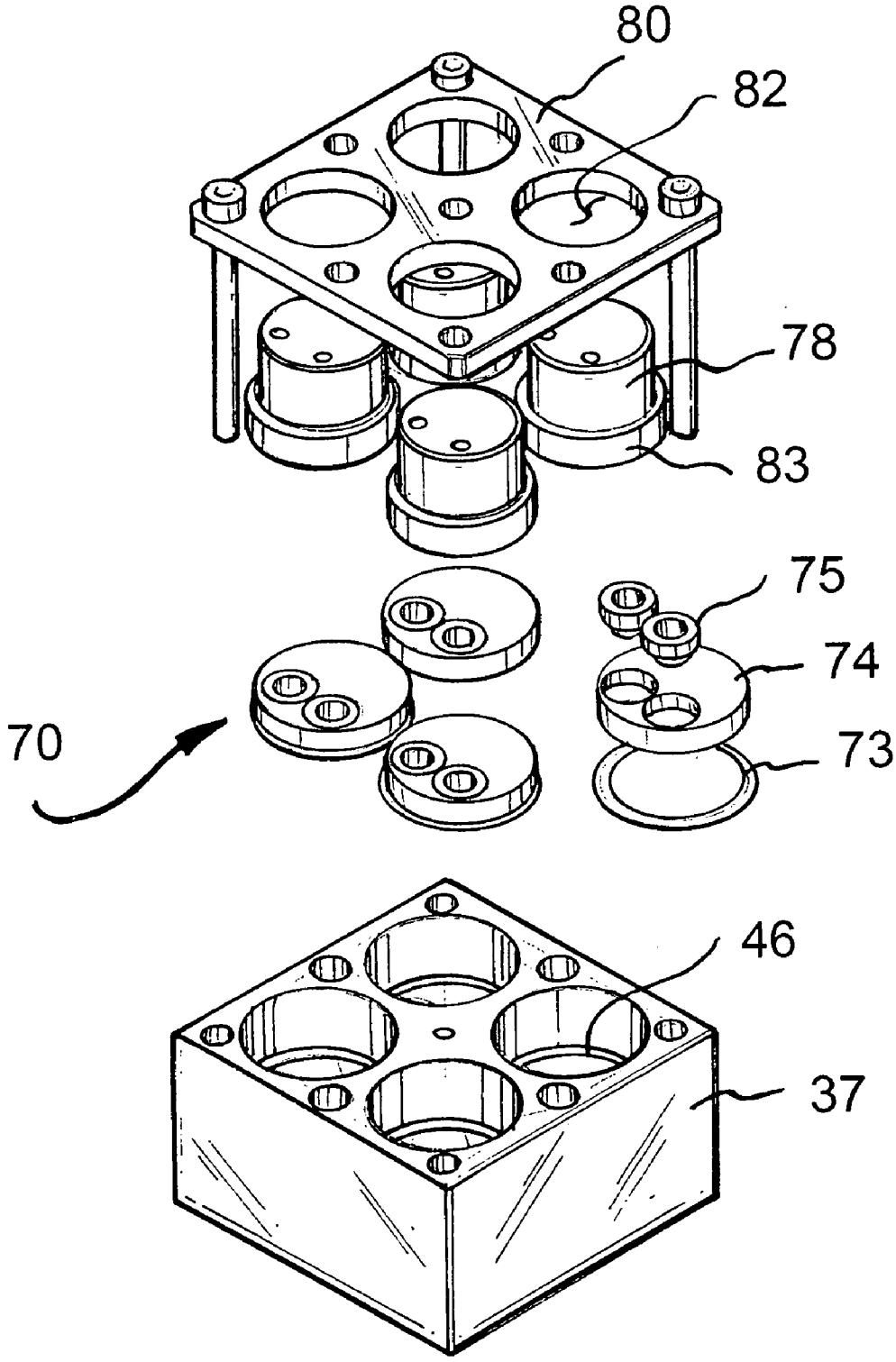
FIG. 13 is an exploded view of the element coupling assembly.

With additional reference to FIGS. 12 and 13, heating elements 40 are inserted through top head manifold 37, into casing 32. Element coupling assembly 70 is employed to securely retain each heating element 40, providing touch safety and coupling each heating element 40 to top head manifold 37. For purposes of this disclosure, touch safety leads includes a flying lead as described previously wherein the leads are potted into a cap of the heating elements, a modified flying lead such as provided by cap assembly 72, and the like. Coupling assembly 70 includes cap assemblies 72 associated with each heater element 40, and a keeper plate 80. When each heater element 40*a-d* and associated cap assembly 72 is positioned through top head manifold 37 such that each cap assembly abuts shoulder 46 of the respective port 45, keeper plate 80 is positioned. Keeper plate 80 includes an opening 82 for each compression cap 78. Compression caps 78 include an enlarged base 83 having a diameter greater than openings 82. When keeper plate 80 is securely bolted to top header manifold 37, and tightened down, each compression cap compresses O-rings 73, seal housings 74 and seals 75 against shoulders 46, sealing heating elements 40 in position and preventing leaks from module 30. Coupling assembly permits removal of any or all heating elements 40*a-d* by removing keeper plate 80. Additionally, cap assemblies 72 prevent accidental or inadvertent contact with leads 63, providing added safety.

Referring back to FIGS. 6, 7, and 8, a water supply inlet 90 is coupled to port 55*a* of bottom head manifold 38. A hot water supply outlet 92 is coupled to port 55*d* of bottom head manifold 38. Water flow through conduits 35 is facilitated by top head manifold 37 and bottom head manifold 38. Water enters water heater module 30 from water supply inlet 90 through port 55*a* of bottom head manifold 38 into conduit 35*a*. Water flows from conduit 35*a* through port 45*a*, channel 49, and port 45*b* of top head manifold 37 into conduit 35*b*. Water flow continues from conduit 35*b* through port 55*b*, channel 58, and port 55*c* of bottom head manifold 38 into conduit 35*c*. Finally, in this four conduit embodiment, water flows from conduit 35*c* through port 45*c*, channel 48, and port 45*d* of top head manifold 37 into conduit 35*d*. From conduit 35*d*, the water exits water heater module 30 through port 55*d* and into hot water supply outlet 92 to be used as desired. In this manner, the temperature of the water can be adjusted relative the flow rate by the number of heating elements 40 powered and to the extent they are powered.

A substantial advantage provided by top head manifold 37 and bottom head manifold 38 is the high degree of control provided over the water flowing through module 30. Specifically, channels 48 and 49 of top head manifold 37 and channel 58 of bottom head manifold 38 can be configured to alter flow characteristics through each conduit 35*d*, 35*b*, and 35*c*, respectively. Flow characteristics include velocity, direction and turbulence generated. These are altered by the volume of each channel (width and depth), and the shape or direction. By increasing the velocity, or directing the flow against another object, for example, turbulence can be created. Turbulence in water flow through a conduit can prevent or reduce surface boiling and stir up any particulate matter, preventing deposits and build-up. The channels permit a high degree of flexibility in module 30 to allow the flow characteristics to be altered as desired.

As can be understood from the description and seen from the drawings, top head manifold 37 and bottom head manifold 38 permit conduits 35 to share much of the thermal energy generated by heating elements 40 instead of radiating the energy to the surrounding environment. Additionally, while a distinct flow path sequentially through conduits 35 having heating elements 40 is provided, top head manifold 37 and bottom head manifold 38 cooperate to form a single container with respect to pressure water heater module 30. Due to this unique characteristic, a pressure relief valve 95 can be employed for increased safety. Pressure relief valve 95 is coupled to side port 47 of top head manifold 37.

Figure 16:
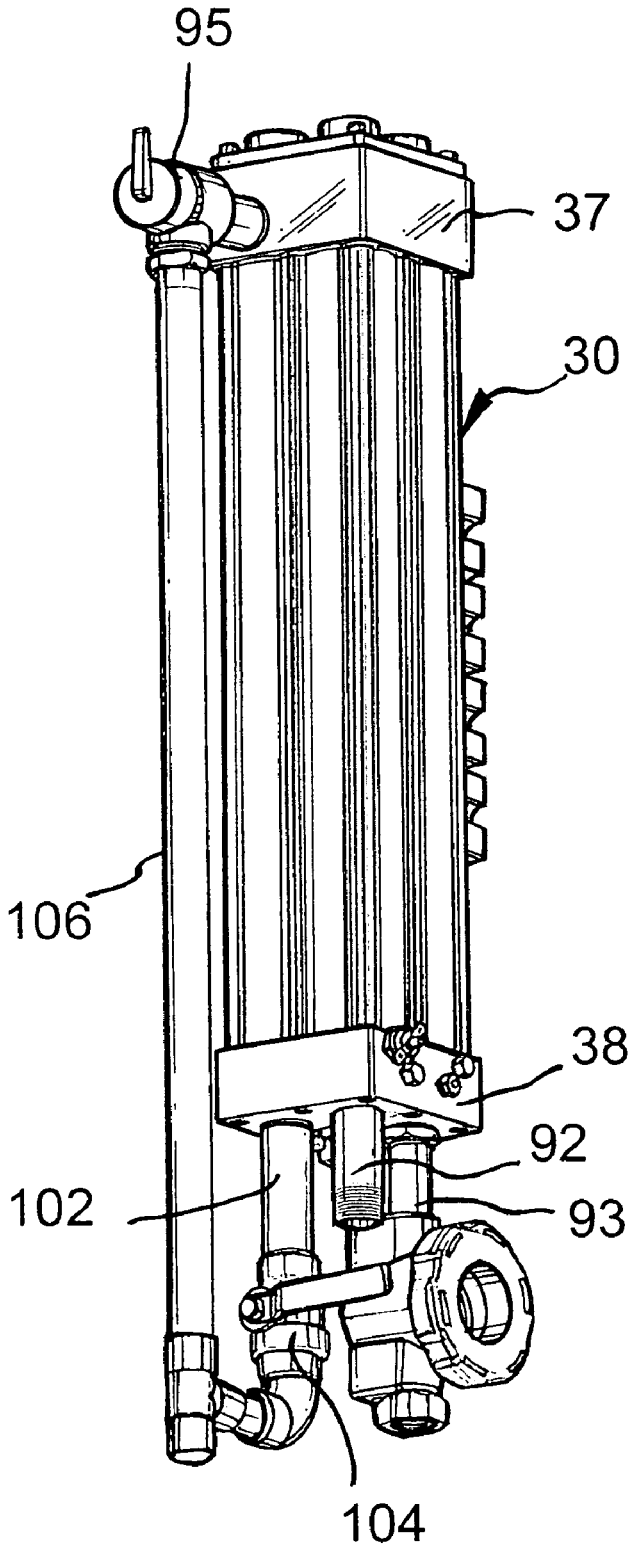
FIG. 16 is a perspective view of the tankless water heater module with flush mechanism.

As briefly mentioned previously, a flush mechanism 100 can be added to the system if desired as shown in FIG. 16. Flush mechanism 100 can be attached to either of the remaining ports 55*b* or 55*c* of bottom head manifold 38. In the embodiment illustrated, cap 46 is removed from port 55*c* and a flush conduit 102 is connected thereto. A valve 104 is coupled to conduit 102 permitting opening and closing thereof to flush water from tankless water heater system 10, and module 30 specifically. Valve 104 can be manually operated or include a solenoid or similar device for automatic operation. Flush conduit 102 can tie into a disposal or drain pipe as available, and can be coupled to a conduit 106 extending from pressure relief valve 95.

Figure 11:
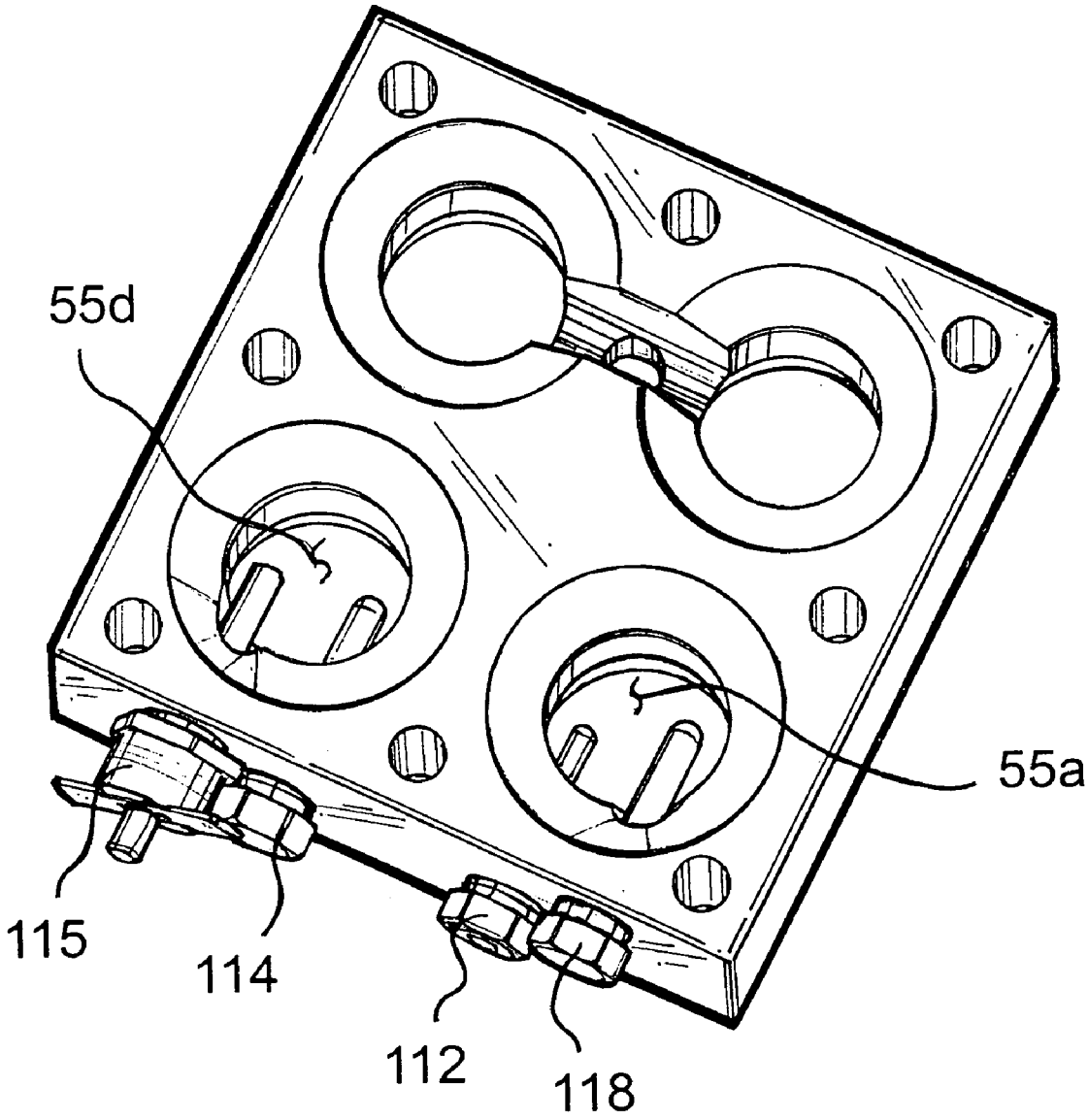
FIG. 11 is a top perspective view of the bottom head manifold of FIG. 14 with sensors installed.
Figure 17:
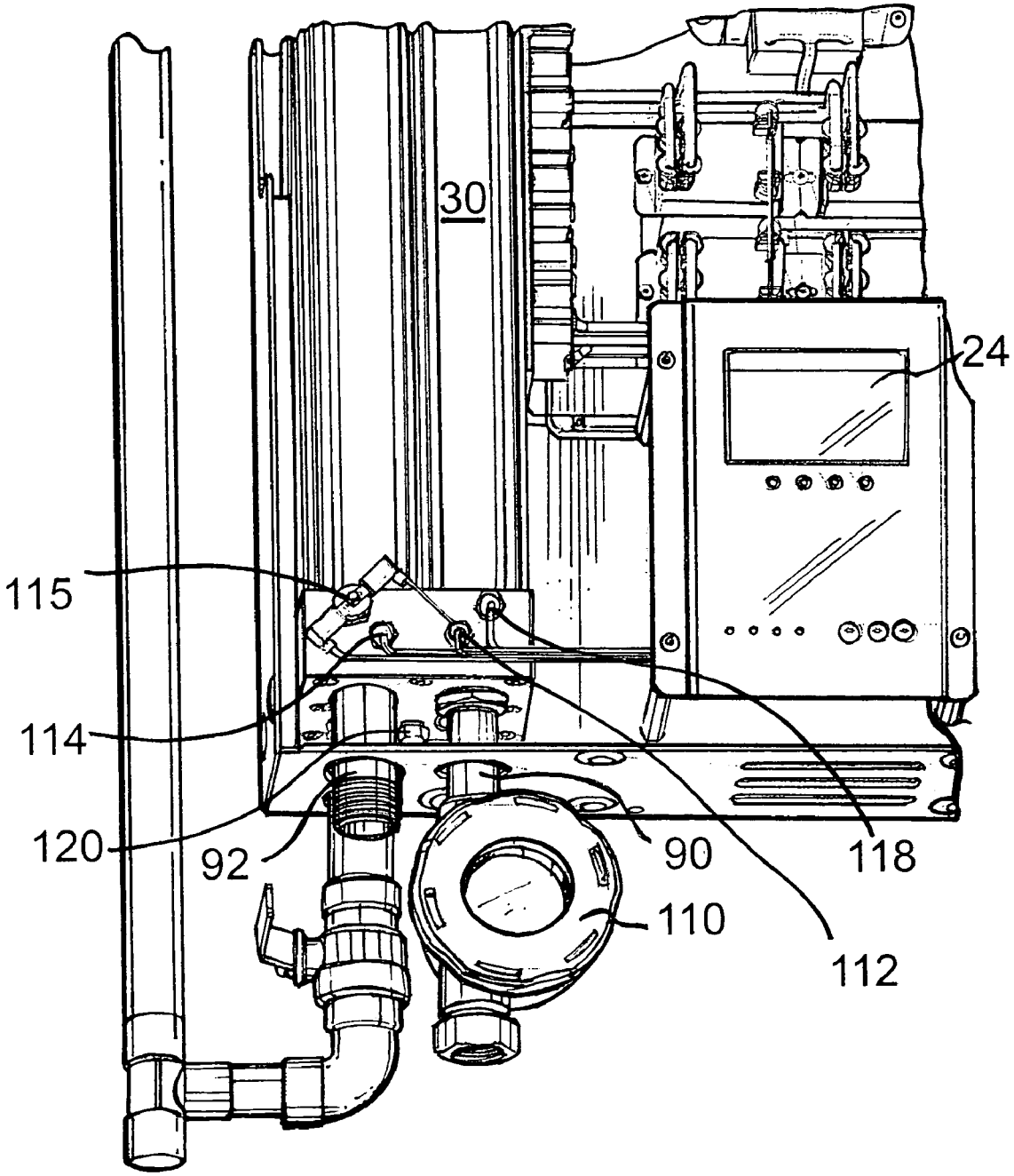
FIG. 17 is an enlarged partial view of the tankless water heater system, illustrating sensors used therein.

With reference to FIGS. 11 and 17, data is provided to control unit 24, by a flow sensor 110 carried by water supply inlet 90. In this embodiment, flow sensor 110 is a paddle wheel pulse flow sensor which allows the volume of water entering water heater module 30 to be measured. Inlet water temperature is sensed by inlet temperature sensor 112 inserted into port 55*a* through aperture 56*a*. Outlet water temperature is sensed by outlet temperature sensor 114 inserted into port 55*d* through aperture 57*a*. Temperature sensors 112 and 114 allow the temperature of water entering and exiting water heater module 30 to be measured. This data is employed by control unit 24 to activate one or more heating elements 40, and adjust the power to each element activated through solid state relay switches 23. Various methodologies can be employed to control and adjust the operation of the heating element. This is typically controlled by software within control unit 24. An over temperature sensor 115 is inserted into port 55*d* through aperture 57*b*. Over temperature sensor 115 senses outlet water temperatures exceeding a specific temperature. When temperatures equal to or exceeding the predetermined temperature are detected, over temperature sensor 115 cuts power to mechanical relays 27, preventing power from reaching relays 23. This circuit is a safety which bypasses controller 24 and shuts down heating elements 40 even if controller 24 signals relays 23 to apply power. A grounding lug 118 is inserted into port 55*a* through aperture 56*b*. Grounding lug 118 permits grounding of the electronic components with module 30.

Still referring to FIGS. 11 and 17, a flow sensor 120 can be added as an addition to or replacement for flow sensor 110. In some instances, the velocity of inflowing water can be at a low level that is difficult to accurately sense. If this is the case, for example, due to large volumes resulting in low velocities, a ribbon flow sensor can be inserted into channel 58 of bottom head manifold 38 through aperture 59. If flow velocities are low enough to cause a detection problem, channel 58 can be narrowed to increase the velocity of the flow therethrough to level which can be accurately measured. Various types of flow sensors can be utilized in this application.

Figure 18:
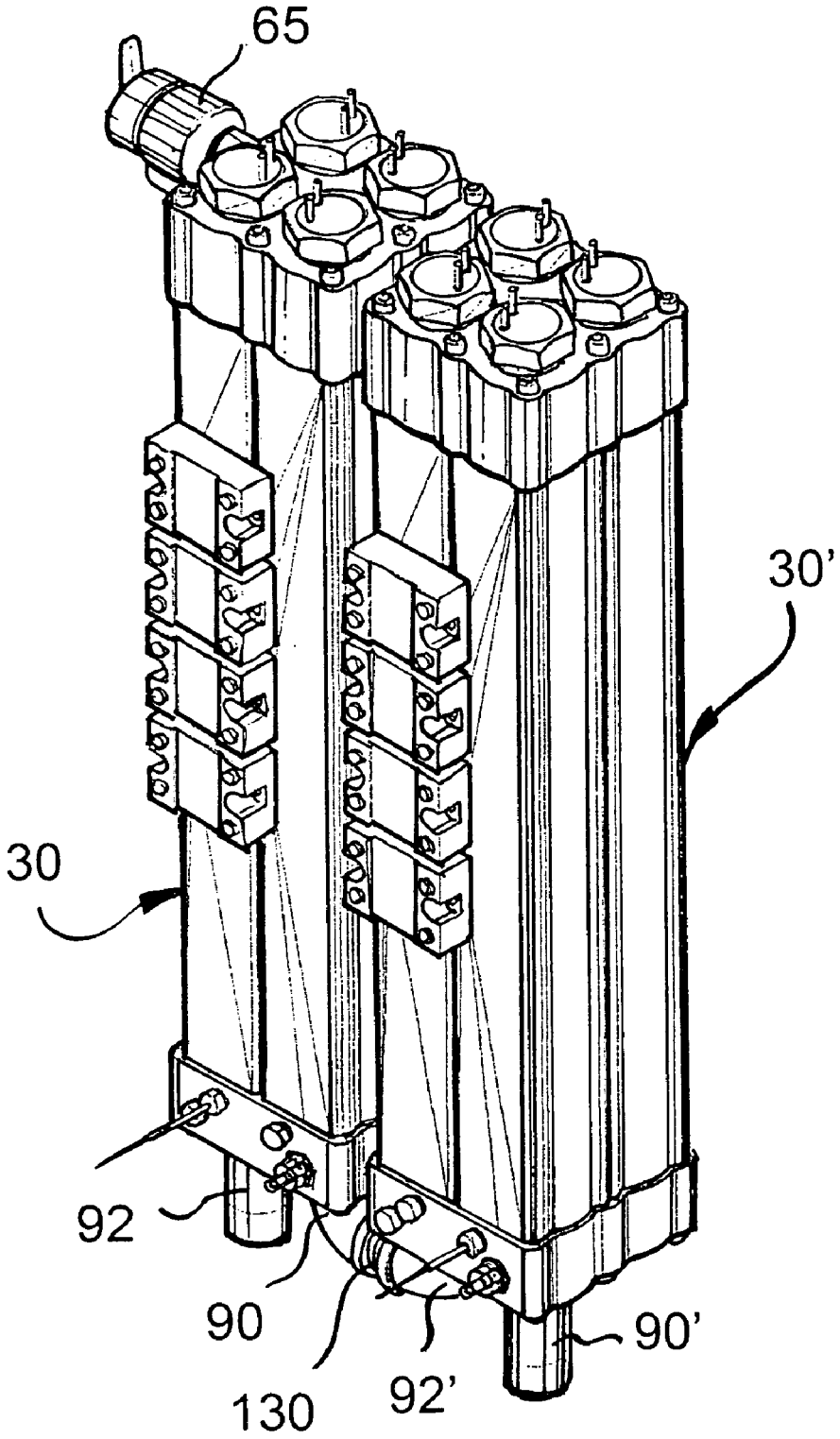
FIG. 18 is a perspective view of a pair of water heater modules coupled in series.
Figure 19:
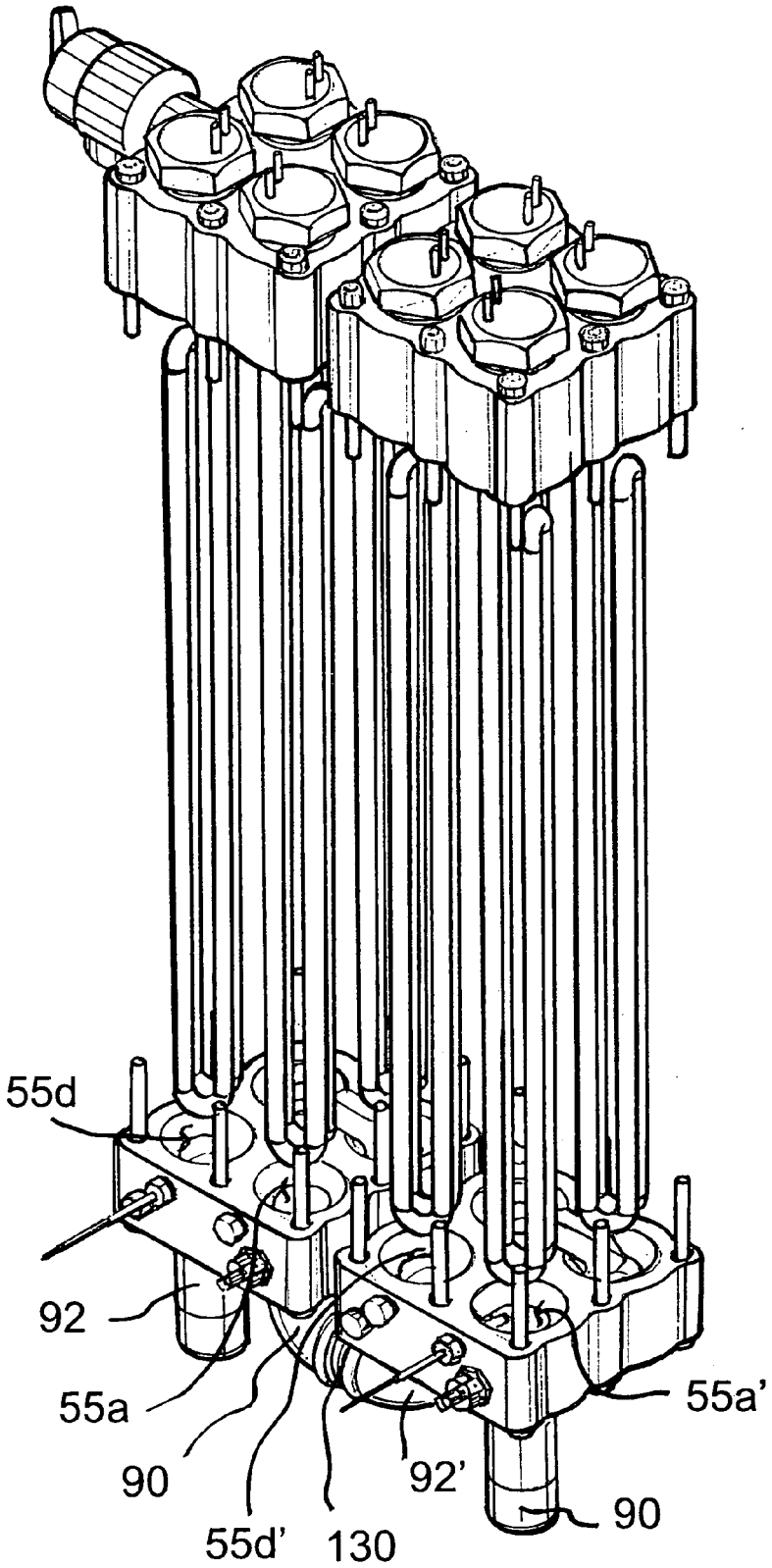
FIG. 19 is perspective view of the water heater modules of FIG. 18 with the casings removed.
Figure 20:
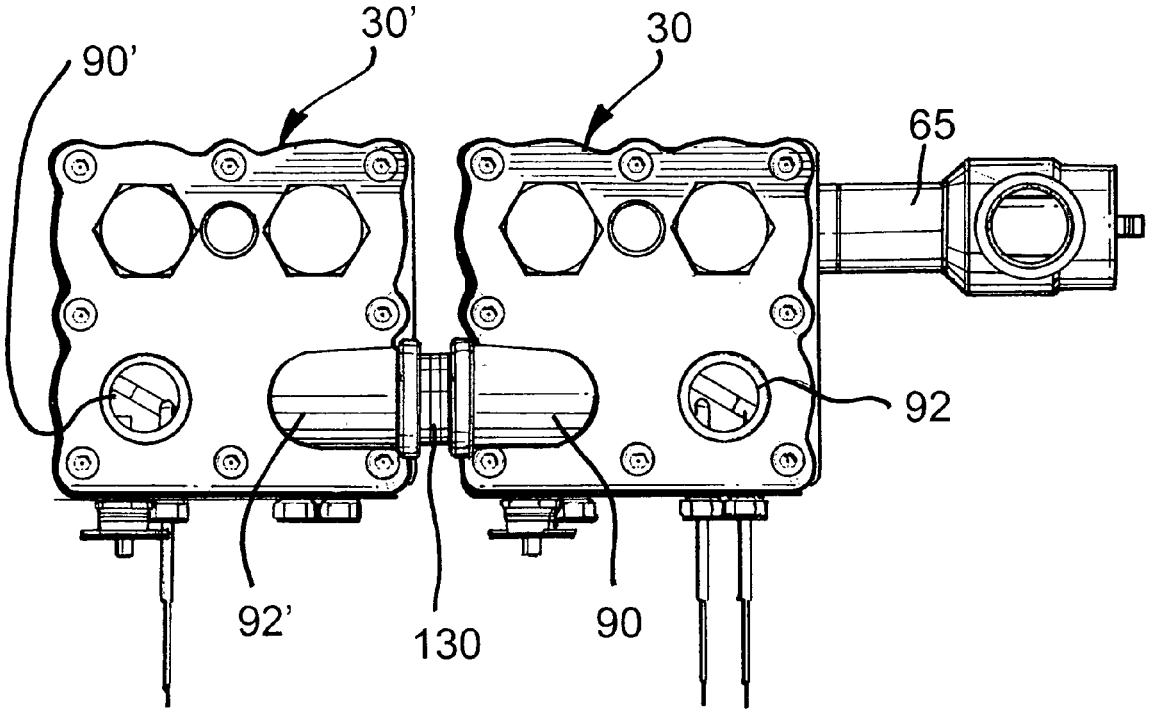
FIG. 20 is a bottom plan view of the water heat heater modules of FIG. 18.

As briefly touched upon previously, tankless water heater system 10 can be expanded to increase its capacity by include multiple water heater modules 30. Referring to FIGS. 18, 19, and 20, a pair of water heater modules 30 are coupled in series. It will be understood that modules 30 can be coupled In parallel or in series using reverse return techniques. As can be seen, each is identical and therefore interchangeable to provide a modular, expandable system. For purposes of this description, reference numerals will be modified with a prime for the additional module. Water heater module 30 is generally identical to that described previously in FIG. 4 with water inlet 90 coupled to water outlet 92' of water heater module 30'. Water heater 30' is substantially identical to water heater module 30. A water supply inlet 90' is coupled to water heater module 30'. Thus, water enters water heater module 30' through port 55*a*', flows through the conduits as previously described and exits water heater module 30' through port 55*d*'. Water exiting water heater module 30' enters into coupling conduit 130 coupling water outlet 92' to water inlet 90. Water flows through the conduits as previously described and exits water heater module 30 through port 55*d*. Adding additional modules expands the capacity of system 10 to heat water. An expandable system can include housing 12 having the capacity to receive one or more additional water heater modules 30 with the ability to add corresponding terminal and breaker switch combinations 25.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A method of heating water comprising the steps of:

providing a tankless water heater module including a casing having a first end, a second end, and a plurality of conduits formed therein, extending from the first end to the second end, a top head manifold coupled to the first end of the casing and including a port aligned with each of the plurality of conduits, a bottom head manifold coupled to the second end of the casing including a port aligned with each of the plurality of conduits, an immersion heating element extending through each port of the top head manifold and into the conduit aligned therewith, each immersion heating element coupled to the top head manifold, and a flow path from through the plurality of conduits, the plurality of conduits coupled in fluid communication by channels between ports of the top head manifold and between ports of the bottom head manifold;

injecting water into the flow path, sensing a flow rate of water through the flow path;

sensing temperature of water entering the flow path and temperature of water exiting the flow path;

supplying power to selected heating elements determined by the flow rate, the temperature of water entering the flow path and the temperature of water exiting the flow path.

2. A method as claimed in claim 1 wherein the step of supplying power comprises the steps of:

providing a power module coupled to a power source;

coupling a relay switch to each immersion heating element and to the power module; and coupling a control unit receiving fluid flow data and fluid temperature data from the water heater module, to the relay switches for actuating the relay switches upon selected fluid flow and fluid temperature data.

3. A method as claimed in claim 1 further including the step of flushing the water heater module by opening a flush valve coupled to the flow path through the bottom head manifold.

4. A method as claimed in claim 1 further including the step of adjusting the flow characteristics of water in the flow path by altering at least one of the channels in one of the top head manifold and the bottom head manifold.

5. A method as claimed in claim 1 wherein the step of determining the flow rate of water through the flow path includes inserting a flow sensor into a channel between ports of one of the top head manifold and the bottom head manifold, and increasing the flow rate of water through the channel between ports of one of the top head manifold and the bottom head manifold to a rate easily determined by the flow sensor.

6. A method as claimed in claim 1 further including the step of increasing or decreasing the heating capacity of the water heater module by removing at least one heating element and inserting therefore a heating element having a greater or lesser heating capacity, respectively.

7. A method as claimed in claim 2 further including the step of increasing water heating capacity by serially coupling a second water heater module to the water heater module, and coupling the second water heater module to the power module and the control unit.

* * * * *